US005959412A

United States Patent [19]

Ushijima

[11] Patent Number: 5,959,412

[45] Date of Patent: Sep. 28, 1999

[54] INVERTER CIRCUIT FOR DISCHARGE TUBE HAVING IMPEDANCE MATCHING CIRCUIT

[76] Inventor: Masakazu Ushijima, 6-30-24, Nogata, Nakano-ku, Tokyo 165, Japan

[21] Appl. No.: 08/796,989

[22] Filed: Feb. 7, 1997

[51] Int. Cl.[6] ..... H05B 41/24

[52] U.S. Cl. ..... 315/276; 315/283; 315/209 PZ; 315/209 R

[58] Field of Search ..... 315/283, 224, 315/209 R, 276, 219, 291, 209 PZ

[56] References Cited

U.S. PATENT DOCUMENTS

| | | | |
|---|---|---|---|
| 4,286,194 | 8/1981 | Sherman | 315/209 R |
| 4,937,834 | 6/1990 | Egawa | 372/38 |
| 5,416,387 | 5/1995 | Cuk et al. | 315/209 R |

*Primary Examiner*—Arnold Kinkead
*Attorney, Agent, or Firm*—McDermott, Will & Emery

[57] ABSTRACT

There is provided an inverter circuit for a discharge tube which does not degrade a lighting brightness of a discharge tube even if a driving frequency is increased in order to miniaturize a step-up transformer and so forth, or which does not degrade a lighting brightness of a discharge tube, this is because a voltage applying to a discharge tube is decreased even if peripheral parasitic capacitance of the discharge tube is increased. The inverter circuit for the discharge tube comprises a high frequency oscillating circuit OS and a step-up transformer for boosting an output of the OS, and the discharge tube DT is connected to a secondary side thereof. An impedance matching circuit 10 for matching the impedance of a circuit until the secondary side and the discharge tube is connected to the secondary side of the step-up transformer which consists of a magnetic leakage flux type wire wound transformer having a secondary winding including at least one closely coupled section which is closely coupled to a primary winding and one loosely coupled section which is loosely coupled to the primary winding respectively or a piezoelectric transformer.

3 Claims, 5 Drawing Sheets

INVERTER CIRCUIT FOR DISCHARGE TUBE HAVING IMPEDANCE MATCHING CIRCUIT

BACKGROUND OF THE INVENTION

1. Field of the Invention

The present invention relates to an inverter circuit for a discharge tube for lighting and driving a discharge tube such as a cold-cathode fluorescence tube, a hot-cathode fluorescence tube, a mercury lamp, a sodium lamp, a metal halide lamp, or a negative glow lamp.

2. Description of the Prior Art

Lighting of the discharge tube requires both of a high-voltage power supply such as commercial power supply system and a lightening circuit consisting of a ballast. In recent years, an inverter circuit is used for obtaining a high voltage power supply from a low voltage DC power supply, for the purpose of miniaturization of the lightening circuit or for the purpose of dissemination of a portable type equipment.

Conventionally, as shown in FIG. 9, this kind of inverter circuit is generally used. The inverter circuit comprises a pair of transistors $Q_1$ and $Q_2$, a step-up transformer T having a primary winding $L_1$, a secondary winding $L_2$, and an auxiliary winding $L_3$. The collectors of transistors $Q_1$ and $Q_2$ are connected to the both sides of the primary winding $L_1$ of the step-up transformer T, the emitters thereof are interconnected each other, and connected to ground. Further, the intermediate point of the primary winding $L_1$ is connected to the bases of the transistors $Q_1$ and $Q_2$ through the resistances $R_1$ and $R_2$ and to each end of the auxiliary winding $L_3$ of the step-up transformer T. A collector resonance type high-frequency oscillating circuit OS of the inverter circuit is composed of the primary winding $L_1$ of the step-up transformer T, the capacitor C1 which is connected parallel thereto, the transistors $Q_1$ and $Q_2$, and the auxiliary winding $L_3$ and the like.

One terminal of the secondary winding $L_2$ of the step-up transformer T is connected to one end of the discharge tube DT through the ballast capacitor $C_2$ and electrical wiring L, and the other terminal thereof is connected to the another end of the discharge tube DT and to ground. Further, $C_3$ is parasitic capacitance of the secondary winding $L_2$, and $C_4$ is parasitic capacitance at periphery of the discharge tube DT.

In the case of the above-described inverter circuit, the step-up transformer takes up the largest space in regard to the circuit. Since it is difficult to miniaturize the step-up transformer, it is incapable of being diminished the shape of the whole inverter circuit. When it allows the driving frequency to increase, the miniaturization of the step-up transformer can be achieved. However, the following method also makes it possible for the whole inverter circuit to miniaturize.

In the above-described conventional circuit, since the circuit is only connected from the high-impedance load to the low-impedance load through the capacitance ballast, an impedance of load as seen from power supply side of high-impedance is hardly matched with an impedance of power supply side as seen from load side. For this reason, when the driving frequency is increased, a reflection is generated in the side of the load, so that a part of supplying capability returns to the side of power supply.

As shown in FIG. 10, caused by a mismatching of the impedance, phase between voltage and electric current is shifted so that the power supply can not be used efficiently.

The electric power which returns to the prior stage is increased, following this, dielectric current is increased. Accordingly, copper loss or dielectric loss is increased depending upon increasing of the reactive current, there occurs the problems that conversion efficiency of the electric power is lowered. The value which is obtained by multiplying a voltage root mean square value by a current root mean square value does not come into the electric power which is provided at the discharge tube.

Furthermore, when the driving frequency is increased, the value of the ballast capacitance $C_2$ is diminished from the view point of the design, with the result that the ratio of parasitic capacitance $C_3$ corresponding to the ballast capacitance $C_2$ becomes large so that it causes the supply voltage to the discharge tube DT to lower, thereby lighting luminance of the discharge tube DT is lowered. In particular, in order to use the discharge tube as a light source for liquid crystal back light, when the reflection member made of the electrically conductive sheet which is formed in such a way that the polyethylene telephthalate film is subjected to sputtering of silver, the parasitic capacitance at periphery of the discharge tube is further increased. The parasitic capacitance at periphery of the discharge tube causes the applied voltage to the discharge tube to lower so that the lighting luminance of the discharge tube DT is greatly lowered.

This phenomenon is similarly generated when the piezo-electric transformer is employed as a step-up transformer. Between a characteristic capacitance which is corresponding to the ballast capacitance $C_2$ involved as the equivalent circuit into the piezo-electric transformer and the parasitic capacitance $C_3$, the same voltage dividing effect as the conventional winding transformer is generated, this causes the burning luminance of the discharge tube DT to lower. Lowering of lighting luminance by the electrical conductive reflection sheet can not be avoided in the piezo-electrical transformer, therefore, in order to lessen the voltage dividing effect, there is a problem that it allows the shape of the piezo-electrical transformer to magnify so that it allows the characteristic capacitance $C_2$ to increase.

SUMMARY OF THE INVENTION

In view of the foregoing, it is an object of the present invention to provide an inverter circuit for a discharge tube which does not degrade a lighting brightness of a discharge tube even if a driving frequency is increased in order to miniaturize a step-up transformer and so forth.

It is another object of the present invention to provide an inverter circuit for a discharge tube which does not degrade a lightening brightness of a discharge tube, this is because a voltage applying to a discharge tube is decreased even if peripheral parasitic capacitance of the discharge tube is increased.

According to one aspect of the present invention, for achieving the above-mentioned objects, there is provided an inverter circuit for a discharge tube including a high-frequency oscillating circuit, a step-up transformer for increasing an output of said high-frequency oscillating circuit, and a discharge tube which is connected to a secondary side of the step-up transformer, the inverter circuit for the discharge tube comprises an impedance matching circuit which performs an impedance matching between the circuit to the secondary side and the discharge tube, is connected to the secondary side of the step-up transformer.

Further, the impedance matching circuit is a $\pi$ type matching circuit which comprises a high-frequency choke coil inserted in series between one end of a secondary side of the step-up transformer and one end of the discharge tube, a parasitic capacitance of a secondary side of the step-up transformer, and a parasitic capacitance generated at a periphery of the discharge tube. Furthermore, when the parasitic capacitance does not arrive at a matching condition, the matching condition is arranged by adding each parasitic capacitance to an auxiliary capacitance.

Moreover, the step-up transformer of the inverter circuit is a leakage flux type wire wound transformer which comprises a primary winding, and a secondary winding having a closely coupled section which is closely coupled to the primary winding, and a loosely coupled section which is loosely coupled to the primary winding, and the impedance matching circuit is a matching circuit which comprises a secondary side parasitic capacitance of the wire wound transformer, an inductive component formed at the loosely coupled section of the secondary winding so as to serve as an inductive ballast when the discharge tube is lighting, a parasitic capacitance of the discharge tube and so forth, and an auxiliary capacitance added additionally.

Moreover, the step-up transformer of the inverter circuit is a piezo-electric type transformer, and the impedance matching circuit of the inverter circuit is a matching circuit which comprises an auxiliary capacitance added additionally, a high-frequency choke coil, and a parasitic capacitance of said discharge tube and an auxiliary capacitance added additionally thereto.

As described above, according to the constitution, it allows the discharge tube to connect to the secondary side of the step-up transformer through the impedance matching circuit to match the impedance of the load as seen from the side of the power supply with the impedance of the power supply as seen from the side of the load to eliminate the phenomenon in which the step-up high-frequency electric power is reflected at the side of the load to be returned a part of the supplied electric power.

In particular, the $\pi$ type matching circuit comprises the high-frequency chock coil inserted in series between one end of the secondary side of the step-up transformer and one end of the discharge tube, the secondary side parasitic capacitance of the step-up transformer, and the parasitic capacitance generated at periphery of the discharge tube. When the discharge tube is lit, the current restriction is suitably performed by the inductive ballast consisting of the high-frequency chock coil. Since the high-frequency chock coil is employed, even if the parasitic capacitance in the side of the discharge tube is large, the voltage applied to the discharge tube does not deteriorate. As the result, even if the parasitic capacitance is increased, it allows the voltage applying to the discharge tube to keep suitably, so that the lighting luminance is not deteriorated.

The secondary winding of the leakage flux type wire wound transformer has closely coupled section which is closely coupled to the primary winding, and has loosely coupled section which is loosely coupled to the primary winding. The impedance matching circuit comprises the secondary side parasitic capacitance of the wire wound transformer, the inductive component formed at the loosely coupled portion of the secondary winding to serve as inductive ballast when the discharge tube is lighting, the parasitic capacitance of the discharge tube, and the auxiliary capacitance, and it causes the impedance of the load as seen from the power supply to match with the impedance of the power supply as seen from the load. The impedance matching circuit can eliminate the phenomenon in which the step-up high-frequency electric power is reflected at the side of the load to be returned a part of the supplied electric power, even if the driving frequency is increased for miniaturizing the step-up transformer and so forth, the lighting luminance is not deteriorated. Further, no particular inductive ballast is connected to constitute the impedance matching circuit, and the step-up high-frequency voltage is applied to the discharge tube until the discharge tube is lighting, and the electric power in which voltage is relatively low and current is restricted is capable of supplying after lighting of the discharge tube.

Moreover, the piezo-electric transformer is employed as the step-up transformer. The circuit which consists of the auxiliary capacitance, the high-frequency choke coil, and the parasitic capacitance of the discharge tube is employed as the impedance matching circuit, and just before the lighting, high voltage is outputted by the high step-up ratio, accordingly chance of lighting of the discharge tube occurs, and after lighting, the lighting current of the discharge tube is restricted by the inductive ballast instead of restricting the lighting current of the discharge tube by the current restricting function of the equivalent capacitance involved into the piezo-electric ceramics forming the piezo-electric transformer. Since the impedance matching circuit is inserted thereinto, it causes the impedance of the load as seen from the power supply to match with the impedance of the power supply as seen from the load. The impedance matching circuit can eliminate the phenomenon in which the step-up high-frequency electric power is reflected at the side of the load to be returned a part of the supplied electric power. When the conductive reflection sheet is used as the reflection material of the discharge tube, the luminance deterioration is capable of being prevented.

DETAILED DESCRIPTION OF THE PREFERRED EMBODIMENTS

Figure 1:
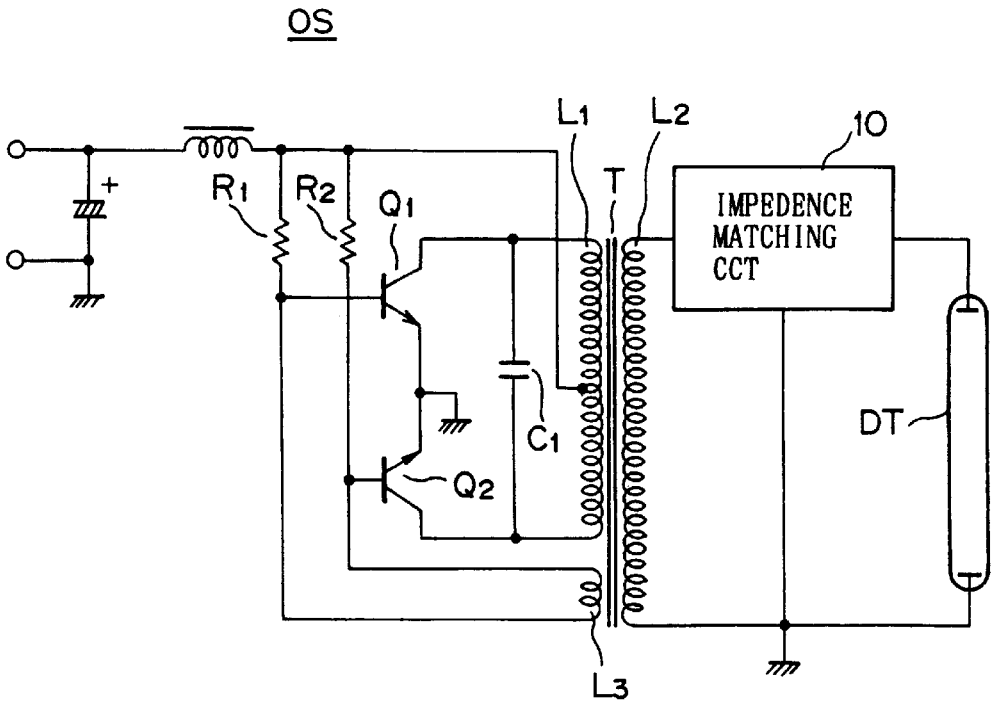
FIG. 1 is a principle circuit view showing an embodiment of an inverter for a discharge tube according to the present invention.
Figure 9:
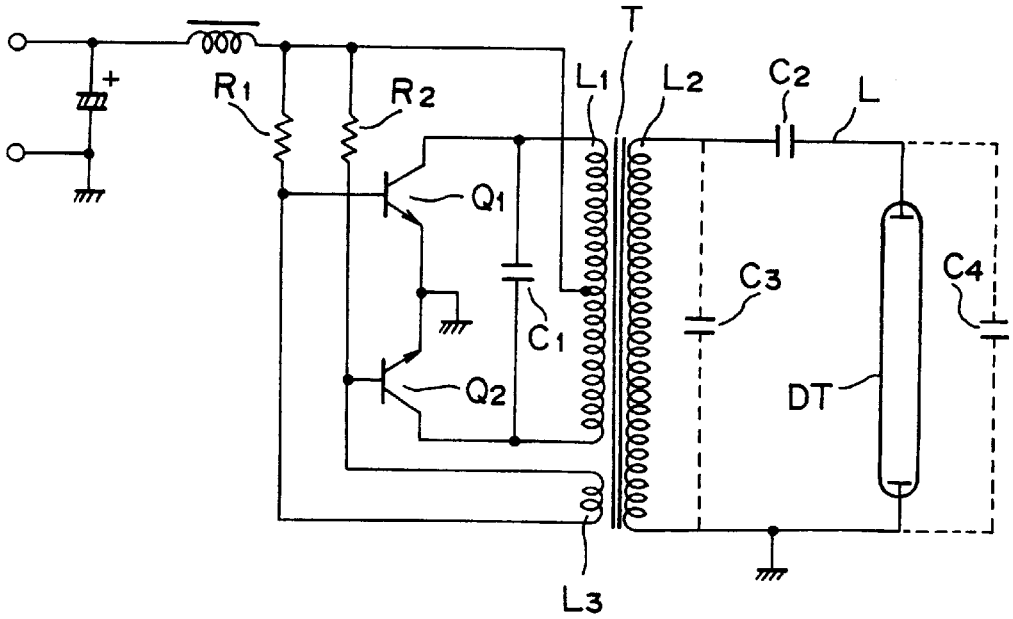
FIG. 9 PRIOR ART
FIG. 9 is a circuit view showing one example of the conventional inverter circuit for the discharge tube.
Figure 10:
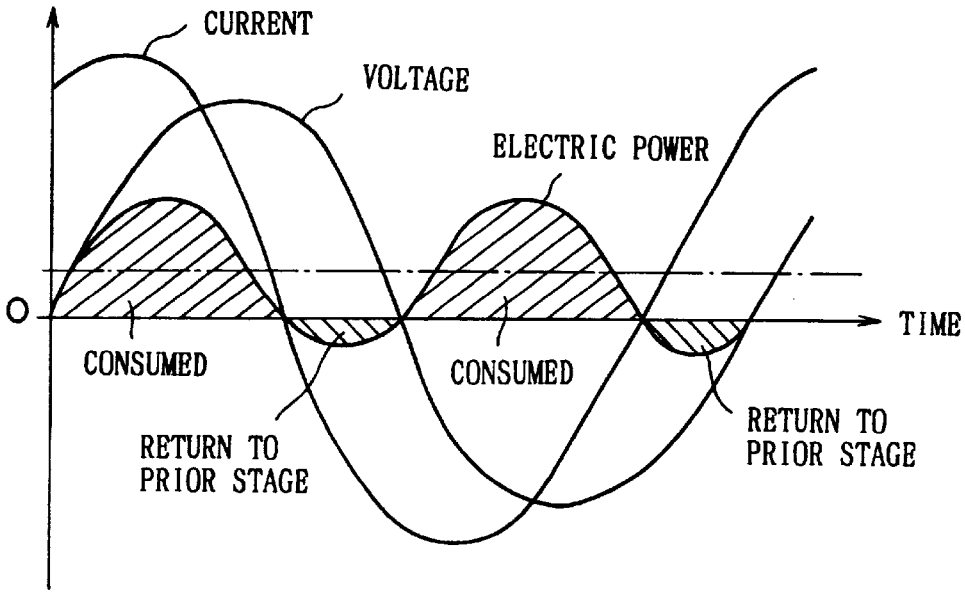
FIG. 10 PRIOR ART
FIG. 10 is a graph explaining conventional problems.

A preferred embodiment of the invention will now be described in detail referring to the accompanying drawings. FIG. 1 is a view showing a principle structure of one embodiment of an inverter circuit according to the present invention, the same symbols corresponding to same part as FIG. 9 are affixed thereto. In FIG. 1, an impedance matching circuit 10 is inserted between one end of a secondary winding $L_2$ of a step-up transformer T and one terminal of a discharge tube DT. The impedance matching circuit 10 matches an impedance as seen from the side of the secondary winding $L_2$ of the step-up transformer T with an impedance of as seen from the side of the discharge tube DT. The impedance matching circuit 10 is constituted in such a way that a parasitic capacitance of the secondary winding $L_2$, and a parasitic capacitance generated at periphery of the discharge tube are taken therein, and prevents a returning of output of the secondary winding $L_2$ by reflection so that it causes the output of the secondary winding $L_2$ to send into the discharge tube DT efficiently.

Figure 2:
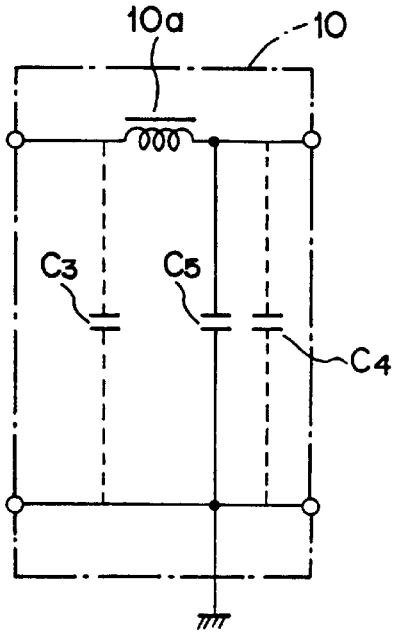
FIG. 2 is a circuit view showing a concrete circuit construction of one part of FIG. 1.

FIG. 2 shows a concrete circuit example of the impedance matching circuit 10 which is the impedance matching circuit constituted by π type matching circuit consisting of a high-frequency choke coil 10*a* inserted in series between one end of the secondary winding $L_2$ of the step-up transformer T and one end of the discharge tube DT, a secondary side parasitic capacitance $C_3$ of the step-up transformer T, and a parasitic capacitance $C_4$ generated at periphery of the discharge tube DT. Further, $C_5$ is an auxiliary capacitance added in parallel when the parasitic capacitance C4 generated at periphery of the discharge tube DT is lacking in capacitance, and a matching adjustment of the impedance is implemented thereby, a capacitance value thereof is capable of being taken zero depending on designing condition.

Figure 3:
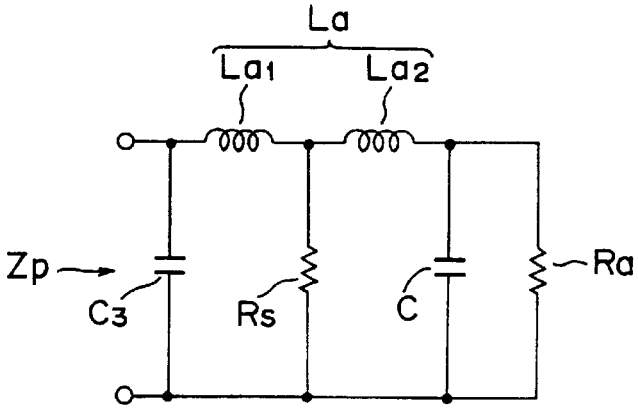
FIG. 3 is a view explaining a method of establishing a circuit constant of the circuit of FIG. 2.

In order to calculate a inductance value La of the choke coil 10*a*, the parasitic capacitance value $C_3$, and a combined capacitance value C of the parasitic capacitance $C_4$ and the auxiliary capacitance $C_5$, it should be considered by replacing to an equivalent circuit shown in FIG. 3. In FIG. 3, Zp is an impedance of secondary load side, Ra is a resistance of the discharge tube DT, both of which are given previously. La is divided into two parts of $La_1$ and $La_2$. $C_3$, $La_1$, $La_2$, and C are found from following method. When $La_2$, C and Ra are removed, and resistance Rs is connected thereto replacing thereof, $C_3$, $La_1$, and Rs are found so that impedance as seen from the left side becomes Zp. Here, each reactance value of $C_3$ and $La_1$ are presumed to be $Xc_3$ and $Xa_1$. Under these conditions, when Zp and Q of the circuit are determined, each constant numbers thereof can be decided by the following Equation (1):

$$\left.\begin{aligned} Rs &= Zp/(1+Q^2) \\ Xa_1 &= QRs \\ Xc_3 &= Zp/Q \end{aligned}\right\} \quad (1)$$

$La_2$, and C are found so that impedance as seen from the terminals which are connected to the resistance Rs becomes Rs. Here, each reactance value of $La_2$ and C are presumed to be $Xa_1$, $Xa_2$, Xc. Under these conditions, when Rs being found from Equation (1) and resistance Ra of the discharge tube DT are determined, each constant numbers thereof can be decided by the following Equation (2):

$$\left.\begin{aligned} Q' &= (Ra/Rs-1)^{1/2} \\ Xa_2 &= Q'Rs \\ Xc &= Ra/Q' \end{aligned}\right\} \quad (2)$$

Here, Q' is Q of the circuit of $La_2$, C, Ra.

From the above Equations (1) and (2), $C_3$, La and C can be calculated by following Equation (3):

$$\left.\begin{aligned} C_3 &= 1/2\pi f Xc_3 \\ La &= (Xa_1+Xa_2)/2\pi f \\ C &= 1/2\pi f Xc \end{aligned}\right\} \quad (3)$$

Here, f is driving frequency.

When the above-described π type impedance matching circuit 10 in regard to FIG. 2 is used, an oscillation signal of the high-frequency oscillation circuit generated at the primary side of the step-up transformer T is set up so that the oscillation signal is induced to the secondary winding $L_2$. The induced high-voltage with high-frequency is supplied to the discharge tube DT without reflection by the operation of the impedance matching circuit 10.

In the embodiment as shown in FIG. 2, the concrete constitution of the high-frequency chock coil 10*a* is not described. However, by using the construction of the leakage flux type step-up transformer T as shown in FIGS. 4 and 5, a function of the choke coil 10*a* is capable of being achieved by the part of the secondary winding $L_2$ of the step-up transformer T. The leakage flux type step-up transformer T of FIGS. 4 and 5 is adopted to become an extreme leakage flux type transformer. In the embodiment of FIG. 4, the shape of the transformer is pillar-like configuration. It is possible to form the transformer in a square pillar-like configuration. In the embodiment of FIG. 5, the shape of the transformer is planar disc-like configuration.

In the embodiment of FIG. 4, concretely, the auxiliary winding $L_3$ (base winding) of the step-up transformer T is wound around at one terminal section of the bobbin 11 in which a log-like core (not illustrated) is inserted into a center hollow section, and the primary winding $L_1$ (collector winding) is wound around at the portion adjacent thereto, and the secondary winding $L_2$ is wound around at the position neighboring thereof. The winding of the secondary winding $L_2$ is started at neighborhood of the primary winding $L_1$, and terminated at the terminal 11*a* formed at the other terminal section of the bobbin 11. When the one end of the secondary winding $L_2$ adjacent to the primary winding $L_1$ is grounded, the terminal of the secondary winding $L_2$ which is the most distant in physical from the primary winding $L_1$ becomes the highest voltage condition. Further, 12 shows a part of a printed substrate with which the step-up transformer T together with electric parts for constituting the inverter circuit are equipped.

In the embodiment of FIG. 5, concretely, a ferrite core 11' whose construction a pillar 12*b* is protruded from the center of the disc 11'*a* to one direction is used, and the auxiliary winding $L_1$ (base winding) and the neighboring primary winding $L_1$ (collector winding) are wound around at periphery of the pillar 11' of the center portion, further the secondary winding $L_2$ is wound around at periphery thereof. The winding of the secondary winding $L_2$ is started at the neighborhood of the primary winding $L_1$, and terminated at an outer peripheral end portion of the disc 11' of the ferrite core 11'. When the one end of the secondary winding $L_2$ adjacent to the primary winding $L_1$ is grounded, the terminal of the secondary winding $L_2$ which is the most distant in physical from the primary winding $L_1$ becomes the highest voltage portion.

Figure 4A:
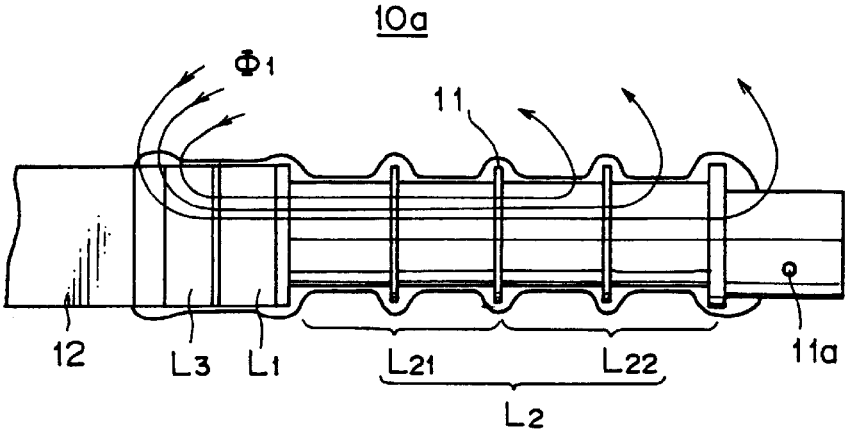
FIG. 4A is a schematic view showing magnetic flux condition of no-load of one example of leakage flux type wound transformer used as the step-up transformer of FIG. 2.
Figure 4B:
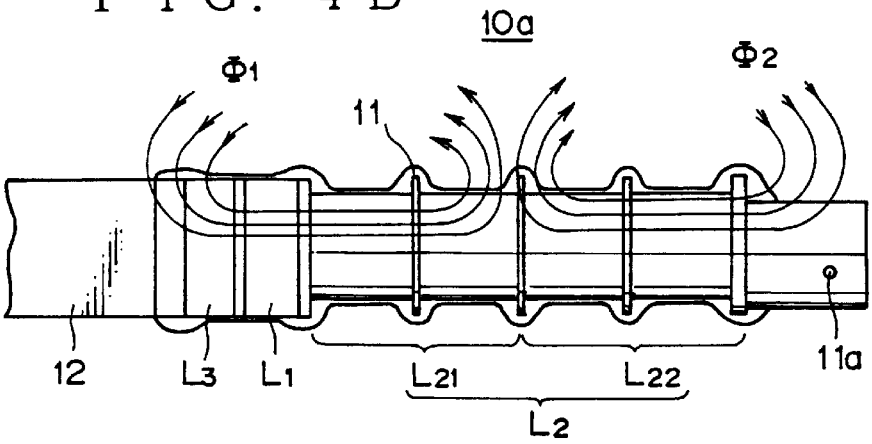
FIG. 4B is a schematic view showing magnetic flux condition of load of one example of leakage flux type wound transformer used as the step-up transformer of FIG. 2.
Figure 5A:
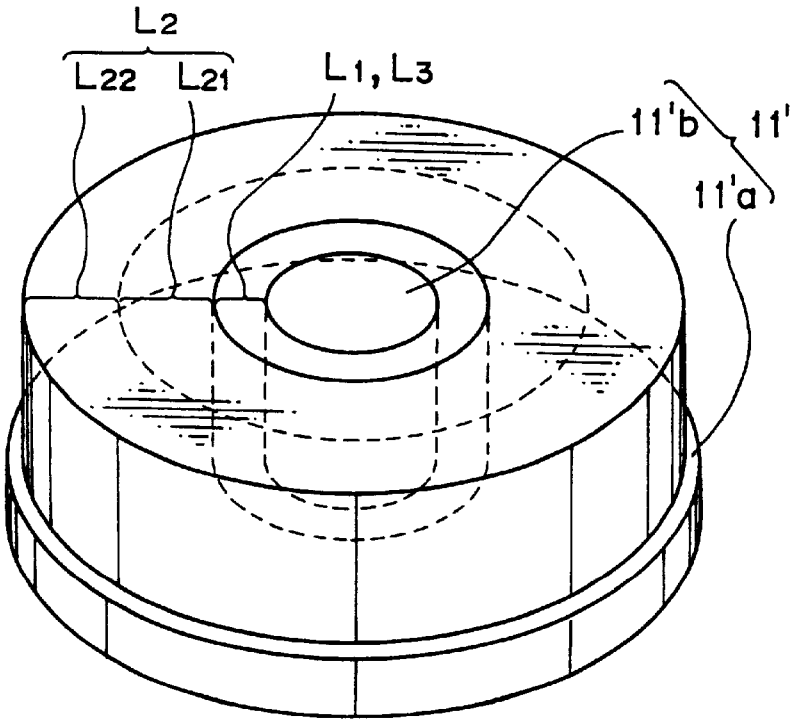
FIG. 5A is an external perspective view showing another embodiment of the leakage flux type of wound transformer used as the step-up transformer of FIG. 2.
Figure 5B:
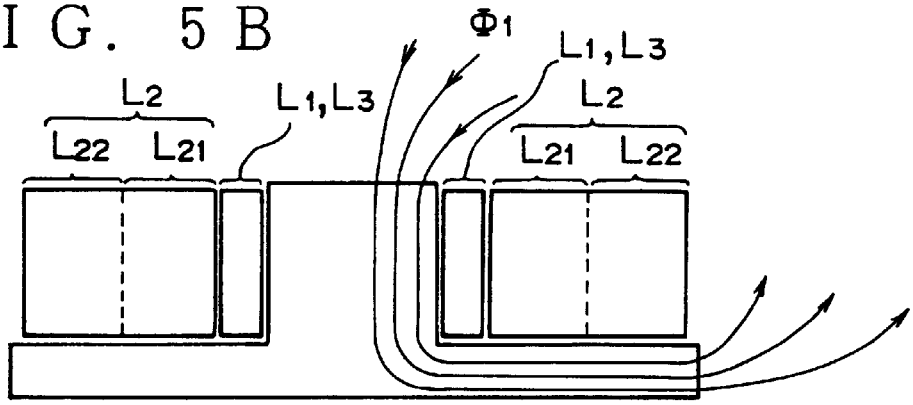
FIG. 5B is view showing magnetic flux condition of no-load of the leakage flux type wound transformer of FIG. 2.
Figure 5C:
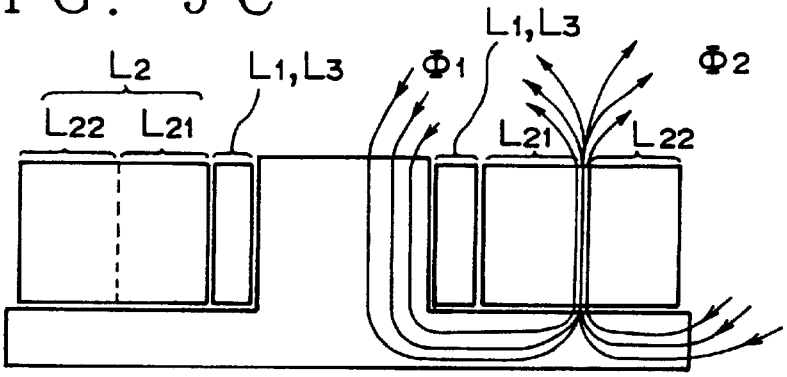
FIG. 5C is view showing magnetic flux condition of load of the leakage flux type wound transformer of FIG. 2.

In regard to FIGS. 4 and 5, in the above-described construction of the step-up transformer, in case of no-load, since no current flows in the secondary winding $L_2$, as shown in FIG. 4A and FIG. 5B, in the primary winding $L_1$ of the transformer T, a magnetic flux $\phi_1$ penetrating the whole length of the core (not shown) within the bobbin 11 is generated. On the other hand, when the load is connected thereto, the secondary winding $L_2$ generates magnetic field due to the current flowing into the load. The direction of the magnetic flux $\phi_2$ caused by the magnetic field, as shown in FIG. 4B and FIG. 5C, becomes reverse direction of the magnetic flux $\phi_1$ generated by the primary winding $L_1$. This generates the phenomenon that the secondary winding $L_2$ is divided into two parts of $L_{21}$ and $L_{22}$. The part of $L_{21}$ which becomes a closely coupled portion to the primary winding, serves as the secondary winding. The part $L_{22}$ which becomes a loosely coupled portion to the primary winding, serves as an inductive ballast namely a chock coil. The branch point of both parts varies due to the relative weight of load, when the load becomes heavy, the branch point moves to the side of the primary winding $L_1$, when the load becomes light, the branch point moves to the side of the terminal.

Due to the action described above, at the un-loaded condition where no current flows in the load, the high voltage induced at the terminal section of the secondary winding $L_2$ is applied to the discharge tube DT which is of the load, while when the discharge tube DT light up to flow the current, due to the operation of the part $L_{22}$ which serves as inductive ballast namely the choke coil, during lighting up, the current flowing in the discharge tube is restricted and the applied voltage is decreased. It is capable of being gained an ideal voltage and current characteristics for necessary lighting up the discharge tube without providing an individual ballast.

Moreover, the part $L_{22}$ which is divided for lighting up the discharge tube DT to serve as the choke coil, is taken in as the high-frequency choke coil La of the impedance matching circuit 10, and the parasitic capacitance of the secondary winding $L_2$ of the wire wound transformer T, and the parasitic capacitance generated at periphery of the discharge tube DT are taken in, so that the impedance matching circuit 10 is capable of being formed. The impedance matching circuit 10 is inserted between the wire wound transformer T and the discharge tube DT, thereby no-output of the secondary winding $L_2$ returns by reflection of the discharge tube DT so that the output of the secondary winding $L_2$ is capable of being sent into the discharge tube DT, with the result that the discharge tube DT can be lighted up with high-intensity.

A concrete example is shown. When core is 2ϕ×23 mm, diameter of wire is 0.040ϕ, and secondary winding is 4000 turns, a parasitic capacitance $C_3$ generated at a secondary winding closely coupled section $L_{21}$ becomes approximately 10 pF (picofarad). Further, an equivalent resistance Ra of the discharge tube DT consisting of a cold cathode fluorescent tube of diameter 3ϕ, 2 W with driving frequency 12 KHz is approximately 75 kΩ, an inductive component La generated from the second winding loosely coupled section $L_{22}$ becomes 80 mH (molihenry). Furthermore, a parasitic capacitance C generated at periphery of the discharge tube DT becomes approximately 30 pF (picofarad). Under these conditions, when an impedance Zp as seen from the side of transformer based upon above Equations (1), (2), and (3) is found. The impedance Zp becomes approximately 188 kΩ consisting of only resistance component. In spite of the simple construction, an impedance matching is implemented to improve a power factor so that an inverter with high efficiency is capable of being provided.

In the above-described embodiment, a wire wound transformer is used as the step-up transformer, however, a piezo-electric transformer can be used as the step-up transformer. The piezo-electric transformer is a mechanical vibration type, consequently, in comparison with the wire wound transformer, there is no leakage flux accordingly it is unnecessary to devise a countermeasure. Further, material thereof is made of ceramics which does not burn so that safety is improved and miniaturization is possible.

Figure 6:
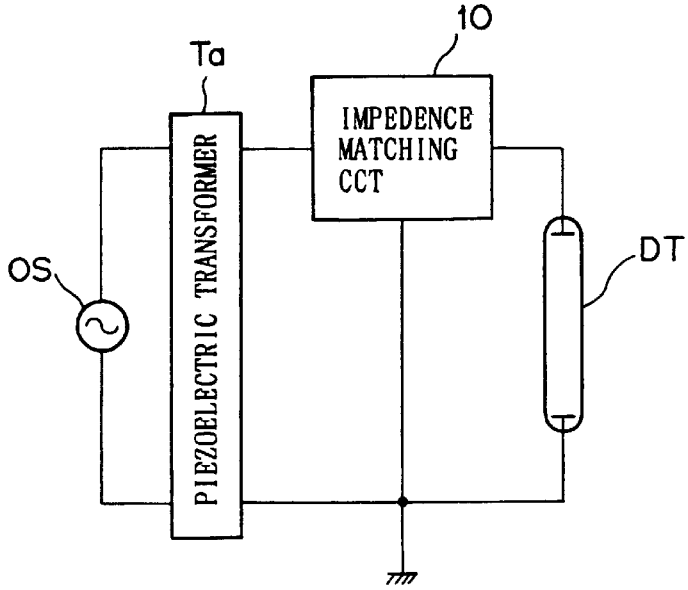
FIG. 6 is a principle circuit view showing one embodiment of the inverter for discharge tube using a piezo-electric transformer according to the invention.

FIG. 6 is a view showing a schematic construction of the inverter for the discharge tube using the piezo-electric transformer Ta as the step-up transformer. In the piezo-electric transformer, a piezo-electric ceramic is inserted between electrodes. The piezo-electric ceramic is high-frequency driven to bend thereof, high charge voltage is generated due to the distortion. Another electrodes which put the same piezo-electric ceramic therebetween can take the high charge voltage out thereof. In FIG. 6, OS is high-frequency oscillating circuit, 10 is the impedance matching circuit, and DT is the discharge tube.

Figure 7:
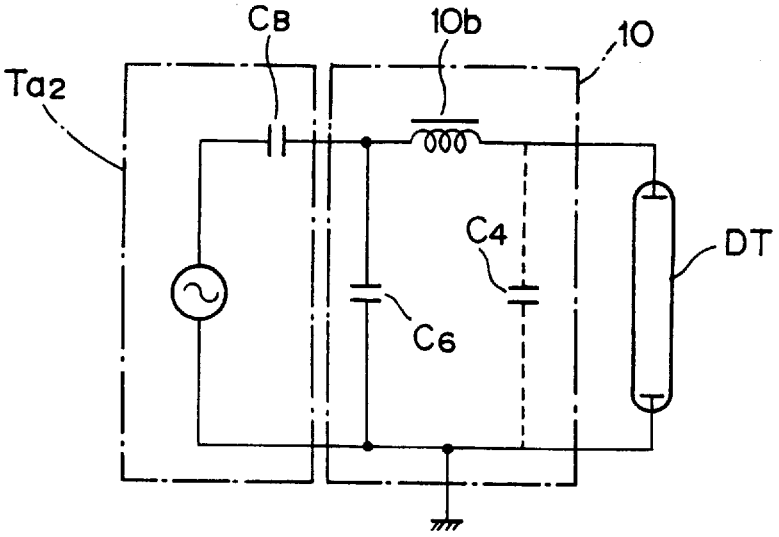
FIG. 7 is a circuit view showing a concrete circuit construction of one part of FIG. 6.

FIG. 7 shows a concrete embodiment of the circuit of the impedance matching circuit 10. The circuit 10 is a π type matching circuit which comprises a high frequency choke coil 10*b* inserted in series between one end of secondary side of the piezo-electric transformer Ta and one end of the discharge tube DT, an auxiliary capacitance $C_6$, and a parasitic capacitance $C_4$ generated at periphery of the discharge tube DT. The constant of high frequency choke coil 10*b*, the auxiliary capacitance $C_6$, and the parasitic capacitance $C_4$ is determined using the same method as described in regard to FIG. 3 so as to constitute the inpedance matching circuit.

FIG. 7 shows $C_B$ within the equivalent circuit $Ta_2$ of the secondary side of the piezo-electric transformer. The construction of the piezo-electric transformer is formed basically that the electrodes are provided on both side of the piezo-electric ceramic. The $C_B$ is an equivalent capacitance of the piezo-electric transformer generated due to the parasitic capacitance between the electrodes. When the capacitance $C_B$ can not be neglected because of so large value of reactance, it is also capable of being formed a π type impedance matching circuit taking the capacitance $C_B$ therein.

Besides, when there is no impedance matching circuit 10, by impedance mismatching, reflection occurs and power factor deteriorates so that large thermal loss is generated by a dielectric loss consisting of a capacitance component of the piezo-electric transformer, with the result that conversion efficiency deteriorates.

Figure 8A:
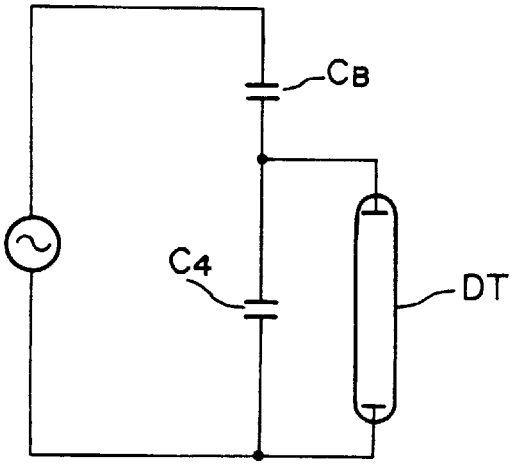
FIG. 8A PRIOR ART
FIGS. 8A and 8B are views explaining conventional problems in case of using a piezo electric transformer.
Figure 8B:
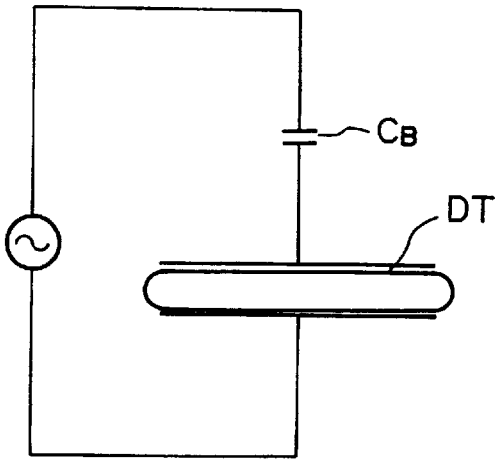
FIG. 8B PRIOR ART

Furthermore, in order to constitute a liquid crystal back light, the discharge tube consisting of a fluorescent tube is arranged as an edge-light of an introducing light body for lighting, and in order to enhance the light lead-in efficiency to the introducing light body, when the discharge tube is covered by silver sheet which reflects the light emitted by the discharge tube, as shown in FIG. 8A, the capacitance generated between the silver sheet and the earth is added to the parasitic capacitance $C_4$ of the discharge tube DT, due to a capacitance potential dividing operation both of the capacitance $C_4$ and the capacitance $C_B$ of the secondary side of the piezo-electric transformer $Ta_2$, it causes the voltage applied to the discharge tube to lower, so that it causes the intensity of the discharge tube to lower. However, when the impedance matching circuit 10 is inserted thereinto, none of these matters occur, so that it is capable of being prevented the lowering of luminance due to the capacitance potential dividing operation. Similar phenomenon occurs in a non-electrode fluorescent tube and so forth which have seeming large amount of characteristic capacitance as shown in FIG. 8B. In such the case, the insertion of the impedance matching circuit 10 produces the same effect.

As described above, according to the present invention, it allows the discharge tube to connect to the secondary side of the step-up transformer through the impedance matching circuit to match the impedance of the load as seen from the side of the power supply with the impedance of the power supply as seen from the side of the load to eliminate the phenomenon in which the step-up high-frequency electric power is reflected at the side of the load to be returned a part of the supplied electric power, even if the driving frequency is increased for miniaturizing the step-up transformer and so forth, the lighting luminance is not deteriorated.

In particular, the π type matching circuit comprises the high-frequency choke coil inserted in series between one end of the secondary side of the step-up transformer and one end of the discharge tube, the secondary side parasitic capacitance of the step-up transformer, and the parasitic capacitance generated at periphery of the discharge tube. When the discharge tube is lit, the current restriction is suitably performed by the inductive ballast consisting of the high-frequency chock coil. Since the high-frequency choke coil is employed, even if the parasitic capacitance in the side of the discharge tube is large, the voltage applied to the discharge tube does not deteriorate. As the result, even if the parasitic capacitance is increased, it allows the voltage applying to the discharge tube to keep suitably, so that the lighting luminance is not deteriorated.

The secondary winding of the leakage flux type wire wound transformer has closely coupled section which is closely coupled to the primary winding, and has loosely coupled section which is loosely coupled to the primary winding. The impedance matching circuit comprises the secondary side parasitic capacitance of the wire wound transformer, the inductive component formed at the loosely coupled portion of the secondary winding to serve as inductive ballast when the discharge tube is lighting, the parasitic capacitance of the discharge tube, and the auxiliary capacitance, and it causes the impedance of the load as seen from the power supply to match with the impedance of the power supply as seen from the load. The impedance matching circuit can eliminate the phenomenon in which the step-up high-frequency electric power is reflected at the side of the load to be returned a part of the supplied electric power, even if the driving frequency is increased for miniaturizing the step-up transformer and so forth, the lighting luminance is not deteriorated. Further, no particular inductive ballast is connected to constitute the impedance matching circuit, and the step-up high-frequency voltage is applied to the discharge tube until the discharge tube is lighting, and the electric power in which voltage is relatively low and current is restricted is capable of supplying after lighting of the discharge tube.

Moreover, the piezo-electric transformer is employed as the step-up transformer. The circuit which consists of the auxiliary capacitance, the high-frequency choke coil, and the parasitic capacitance of the discharge tube is employed as the impedance matching circuit, thereby it causes the capacitance potential dividing operation caused by characteristic capacitance Cb equivalently involved into the piezo-electric transformer, and the parasitic capacitance $C_4$ generated at periphery of the discharge tube to correct the luminance deterioration of the reflection sheet made of silver. Further, just before the lighting, high voltage is outputted by the high step-up ratio, accordingly chance of lighting of the discharge tube occurs, and after lighting, the lighting current of the discharge tube is restricted by the inductive ballast instead of restricting the lighting current of the discharge tube by the current restricting function of the equivalent capacitance involved into the piezo-electric ceramics forming the piezo-electric transformer. Since the impedance matching circuit is inserted thereinto, it causes the impedance of the load as seen from the power supply to match with the impedance of the power supply as seen from the load. The impedance matching circuit can eliminate the phenomenon in which the step-up high-frequency electric power is reflected at the side of the load to be returned a part of the supplied electric power.

While preferred embodiments of the invention have been described using specific terms, and it is to be understood that changes and variations may be made without departing from the spirit or scope of the following claims.

What is claimed is:

1. An inverter circuit for a discharge tube including a high frequency oscillating circuit, a step-up transformer for increasing an output of said high-frequency oscillating circuit, and a discharge tube which is connected to a secondary side of said step-up transformer, said inverter circuit for the discharge tube comprising:

an impedance matching circuit which is inserted between the secondary side of said step-up transformer and said discharge tube to perform an impedance matching between the secondary side of said step-up transformer and said discharge tube to prevent a return loss from being caused when electric power is applied to said discharge tube, wherein said step-up transformer is a leakage flux type wire wound transformer which comprises a primary winding, a secondary winding having a closely coupled section which is closely coupled to said primary winding and a loosely coupled section which is loosely coupled to said primary winding, and wherein said impedance matching circuit is a matching circuit which comprises a secondary side parasitic capacitance of said wire wound transformer, and an inductive component formed at said loosely coupled section of said secondary winding so as to serve as an inductive ballast when said discharge tube is lighting, a parasitic capacitance of said discharge tube, and an auxiliary capacitance added additionally.

2. An inverter circuit for a discharge tube including a high frequency oscillating circuit, a step-up transformer for increasing an output of said high-frequency oscillating circuit, and a discharge tube which is connected to a secondary side of said step-up transformer, said inverter circuit for the discharge tube comprising:

an impedance matching circuit which is inserted between the secondary side of said step-up transformer and said discharge tube to perform an impedance matching between the secondary side of said step-up transformer and said discharge tube to prevent a return loss from being caused when electric power is applied to said discharge tube, wherein said step-up transformer is a piezo-electric type transformer, and wherein said impedance matching circuit is a matching circuit which comprises an auxiliary capacitance added additionally, and a high-frequency choke coil.

3. An inverter circuit for a discharge tube including a high frequency oscillating circuit, a step-up transformer for increasing an output of said high-frequency oscillating circuit, and a discharge tube which is connected to a secondary side of said step-up transformer, said inverter circuit for the discharge tube comprising:

an impedance matching circuit which is inserted between the secondary side of said step-up transformer and said discharge tube to perform an impedance matching between the secondary side of said step-up transformer and said discharge tube to prevent a return loss from being caused when electric power is applied to said discharge tube, wherein said step-up transformer is a piezo-electric type transformer, and wherein said impedance matching circuit is a matching circuit which comprises an auxiliary capacitance added additionally, a high-frequency choke coil, a parasitic capacitance of said discharge tube.

* * * * *